US011818557B2

(12) United States Patent
Nakadai et al.

(10) Patent No.: US 11,818,557 B2
(45) Date of Patent: Nov. 14, 2023

(54) ACOUSTIC PROCESSING DEVICE INCLUDING SPATIAL NORMALIZATION, MASK FUNCTION ESTIMATION, AND MASK PROCESSING, AND ASSOCIATED ACOUSTIC PROCESSING METHOD AND STORAGE MEDIUM

(71) Applicants: HONDA MOTOR CO., LTD., Tokyo (JP); OSAKA UNIVERSITY, Suita (JP)

(72) Inventors: Kazuhiro Nakadai, Wako (JP); Ryu Takeda, Osaka (JP)

(73) Assignees: HONDA MOTOR CO., LTD., Tokyo (JP); OSAKA UNIVERSITY, Suita (JP)

( * ) Notice: Subject to any disclaimer, the term of this patent is extended or adjusted under 35 U.S.C. 154(b) by 0 days.

(21) Appl. No.: 17/677,359

(22) Filed: Feb. 22, 2022

(65) Prior Publication Data

US 2022/0286775 A1 Sep. 8, 2022

(30) Foreign Application Priority Data

Mar. 5, 2021 (JP) ..... 2021-035253

(51) Int. Cl.

| | |
|---|---|
| ***H04R 3/04*** | (2006.01) |
| ***H04R 3/00*** | (2006.01) |
| ***H04S 7/00*** | (2006.01) |
| ***H04R 5/04*** | (2006.01) |

(52) U.S. Cl.

CPC ..... *H04R 3/04* (2013.01); *H04R 3/005* (2013.01); *H04R 5/04* (2013.01); *H04S 7/307* (2013.01)

(58) Field of Classification Search

None

See application file for complete search history.

(56) References Cited

U.S. PATENT DOCUMENTS

2011/0131044 A1* 6/2011 Fukuda ..... G10L 21/028 704/E17.001
2019/0318757 A1* 10/2019 Chen ..... G10L 21/0208
2021/0098014 A1* 4/2021 Tanaka ..... G10K 11/34

OTHER PUBLICATIONS

X. Zhang and D. Wang: "Deep Learning Based Binaural Speech Separation in Reverberant Environments", IEEE/ACM Transactions on Audio, Speech, and Language Processing, vol. 25, No. 5, May 2017, pp. 1075-1084, Discussed in specification, English text, 10 pages.

* cited by examiner

*Primary Examiner* — James K Mooney
(74) *Attorney, Agent, or Firm* — Rankin, Hill & Clark LLP

(57) ABSTRACT

A spatial normalization unit generates a normalized spectrum by normalizing an orientation component of a microphone array for a target direction included in a spectrum of an acoustic signal acquired from each of a plurality of microphones forming the microphone array into an orientation component for a predetermined standard direction. A mask function estimating unit determines a mask function used for extracting a component of a target sound source arriving in the target direction on the basis of the normalized spectrum using a machine learning model. A mask processing unit estimates the component of the target sound source installed in the target direction by applying the mask function to the acoustic signal.

8 Claims, 8 Drawing Sheets

FIG. 9

| TEST SET | | TEST SET 1 | | | | TEST SET 2 | | | |
|---|---|---|---|---|---|---|---|---|---|
| | | 2 VOICES | 3 VOICES | 2 VOICES + NON-VOICE | 4 VOICES | 2 VOICES | 3 VOICES | 2 VOICES + NON-VOICE | 4 VOICES |
| BASELINE | NO PROCESSING | 1.69 / 2.06 | -1.37 / 2.79 | -2.73 / 3.09 | -2.78 / 3.19 | 1.64 / 2.08 | -1.44 / 2.82 | -3.77 / 3.29 | -2.86 / 3.24 |
| | PROCESS A | 8.73 / 1.30 | 4.20 / 1.63 | 1.72 / 2.04 | 1.11 / 1.87 | 5.08 / 1.64 | 1.87 / 1.91 | -1.18 / 2.31 | -2.49 / 2.27 |
| | PROCESS B (J=4) | -1.03 / 1.95 | -4.13 / 2.30 | -6.94 / 2.78 | -5.12 / 2.47 | -1.66 / 2.01 | -4.37 / 2.33 | -7.02 / 2.79 | -5.14 / 2.47 |
| THIS EMBODIMENT | SPATIAL NORMALIZATION + PROCESS A | **10.65 / 1.22** | **6.11 / 1.50** | **5.34 / 1.78** | **3.33 / 1.69** | 5.27 1.65 | 3.99 / **1.75** | **1.72 / 2.07** | **-1.09 / 2.20** |
| | SPATIAL NORMALIZATION + PROCESS B (J=2) | 9.20 / 1.29 | 4.62 / 1.61 | 2.43 / 1.95 | 1.94 / 1.79 | -0.53 / 2.02 | -0.17 / 2.04 | -4.37 / 2.45 | -4.99 / 2.44 |
| | SPATIAL NORMALIZATION + PROCESS B (J=3) | 9.60 / 1.28 | 5.11 / 1.58 | 3.47 / 1.90 | 2.07 / 1.79 | 3.78 / 1.90 | 2.63 / 1.93 | 0.23 / 2.24 | -2.55 / 2.34 |
| | SPATIAL NORMALIZATION + PROCESS B (J=4) | 10.33 / 1.23 | 5.99 / 1.51 | 4.52 / 1.81 | 2.97 / 1.71 | **6.24 / 1.58** | **4.16** / 1.76 | 1.58 / 2.07 | -1.51 / 2.25 |

ACOUSTIC PROCESSING DEVICE INCLUDING SPATIAL NORMALIZATION, MASK FUNCTION ESTIMATION, AND MASK PROCESSING, AND ASSOCIATED ACOUSTIC PROCESSING METHOD AND STORAGE MEDIUM

CROSS-REFERENCE TO RELATED APPLICATION

Priority is claimed on Japanese Patent Application No. 2021-035253, filed Mar. 5, 2021, the content of which is incorporated herein by reference.

BACKGROUND OF THE INVENTION

Field of the Invention

The present invention relates to an acoustic processing device, an acoustic processing method, and a storage medium.

Description of Related Art

Sound source separation is a technology for separating components based on individual sound sources from an acoustic signal including a plurality of components. Sound source separation is useful for analyzing surrounding environments in the aspect of acoustics, and applications thereof to a wide array of fields for various uses have been attempted. Representative application examples include automated driving, a device operation, a voice conference, control of operations of a robot, and the like. For sound source separation, techniques using a difference in sound transfer characteristics according to a difference in the spatial position relation from a sound source to individual microphones using the microphones of which positions are different from each other has been proposed. Among them, selective sound source separation (selective sound separation) is a function that is important for sound source separation.

Selective sound source separation is separation of components of sounds arriving from sound sources present in a specific direction or at a specific position. The selective sound source separation, for example, is applied for acquisition of a voice generated by a specific speaker. In Patent Document 1 as represented below, a technique for separating a target sound source component from acoustic inputs from two microphones in a reverberant environment is proposed (stereo device sound source separation (binaural sound source separation)). In Non-Patent Document 1, a technique for estimating a mask for extracting a target sound from a spectrum characteristic quantity and a space characteristic quantity acquired from an acoustic input using a neural network is described. The estimated mask is used by being applied to an acoustic input to relatively emphasize a target sound in a specific direction and reduce noise components in other directions.

[Non Patent Literature 1] X. Zhang and D. Wang: "Deep Learning Based Binaural Speech Separation in Reverberant Environments," IEEE/ACM TRANSACTIONS ON AUDIO, SPEECH, AND, LANGUAGE PROCESSING, VOL. 25, NO. 5, May 2017

SUMMARY OF THE INVENTION

However, generally, there are various patterns of spatial relations between the number and positions of sound sources in a real acoustic environment. In a case in which all the patterns are considered, model parameters of a neural network need to be learned in advance such that they are appropriate for individual patterns in addition to setting such patterns in advance. For this reason, the amount of processing and effort related to learning of model parameters may be enormous. The number and positions of sound sources may dynamically change, and thus it cannot be determined that a component of a target sound source can be acquired with sufficient quality using the patterns set in advance.

An aspect of the present invention is in view of the points described above, and one object thereof is to provide an acoustic processing device, an acoustic processing method, and a storage medium capable of reducing spatial complexity used for sound source separation.

In order to achieve a related object by solving the problems described above, the present invention employs the following forms.

(1): According to one aspect of the present invention, there is provided an acoustic processing device including: a spatial normalization unit configured to generate a normalized spectrum by normalizing an orientation component of a microphone array for a target direction included in a spectrum of an acoustic signal acquired from each of a plurality of microphones forming the microphone array into an orientation component for a predetermined standard direction; a mask function estimating unit configured to determine a mask function used for extracting a component of a target sound source arriving in the target direction on the basis of the normalized spectrum using a machine learning model; and a mask processing unit configured to estimate the component of the target sound source installed in the target direction by applying the mask function to the acoustic signal.

(2): In the aspect (1) described above, the spatial normalization unit may use a first steering vector representing directivity for the standard direction and a second steering vector representing directivity for the target direction in the normalization.

(3): In the aspect (1) or (2) described above, a space filtering unit configured to generate a space correction spectrum by applying a space filter representing directivity for the target direction to the normalized spectrum may be further included. The mask function estimating unit may determine the mask function by inputting the space correction spectrum to the machine learning model.

(4): In any one of the aspects (1) to (3) described above, a model learning unit configured to determine a parameter set of the machine learning model such that a residual between an estimated value of the component of the target sound source acquired by applying the mask function to the acoustic signal representing sounds arriving from a plurality of sound sources including the target sound source and a target value of the component of the target sound source is small may be further included.

(5): In any one of the aspects (1) to (4) described above, the model learning unit may determine a space filter for generating a space correction spectrum from the normalized spectrum. The estimated value of the component of the target sound source may be acquired by applying the mask function to the space correction spectrum.

(6): In any one of the aspects (1) to (5) described above, a sound source direction estimating unit configured to determine a sound source direction on the basis of a plurality of acoustic signals may be further included. The spatial normalization unit may use the sound source direction as the target direction.

(7) According to one aspect of the present invention, there is provided a computer-readable non-transitory storage medium storing a program thereon, the program causing a computer to function according to any one of the aspects (1) to (6) described above.

(8): According to one aspect of the present invention, there is provided an acoustic processing method including: a first step of generating a normalized spectrum by normalizing an orientation component of a microphone array for a target direction included in a spectrum of an acoustic signal acquired from each of a plurality of microphones forming the microphone array into an orientation component for a predetermined standard direction; a second step of determining a mask function used for extracting a component of a target sound source arriving in the target direction on the basis of the normalized spectrum using a machine learning model; and a third step of estimating the component of the target sound source installed in the target direction by applying the mask function to the acoustic signal.

According to the aspects (1), (7), and (8) described above, the normalized spectrum used for estimating the mask function is normalized such that it includes an orientation component for the standard direction, and thus a machine learning model assuming all the sound source directions does not need to be prepared. For this reason, while the quality of the component of the target sound source acquired through sound source separation is secured, the space complexity of the acoustic environment in model learning can be reduced.

According to the aspect (2) described above, by using the first and second steering vectors that can be used also in the process of another microphone array starting from estimation of the direction of the sound source, spatial normalization can be realized by employing a simple process and a simple configuration.

According to the aspect (3) described above, the component of the target sound source installed in the target direction included in the acquired acoustic signal is reliably acquired, and thus the quality of the component of the estimated target sound source can be secured.

According to the aspect (4) described above, a machine learning model used for determining a mask function for estimating the component of the target sound source by being applied to the acoustic signal can be learned.

According to the aspect (5) described above, a parameter set of the machine learning model and a space filter used for generating a space correction spectrum input to the machine learning model can be simultaneously solved and determined.

According to the aspect (6) described above, even for a target sound source of which a target direction is unknown, the component of the target sound source can be estimated.

BRIEF DESCRIPTION OF DRAWINGS

FIG. 9 is a table illustrating qualities of extracted target sound source components.

DETAILED DESCRIPTION OF THE INVENTION

Hereinafter, an embodiment of the present invention will be described with reference to the drawings.

Figure 1:
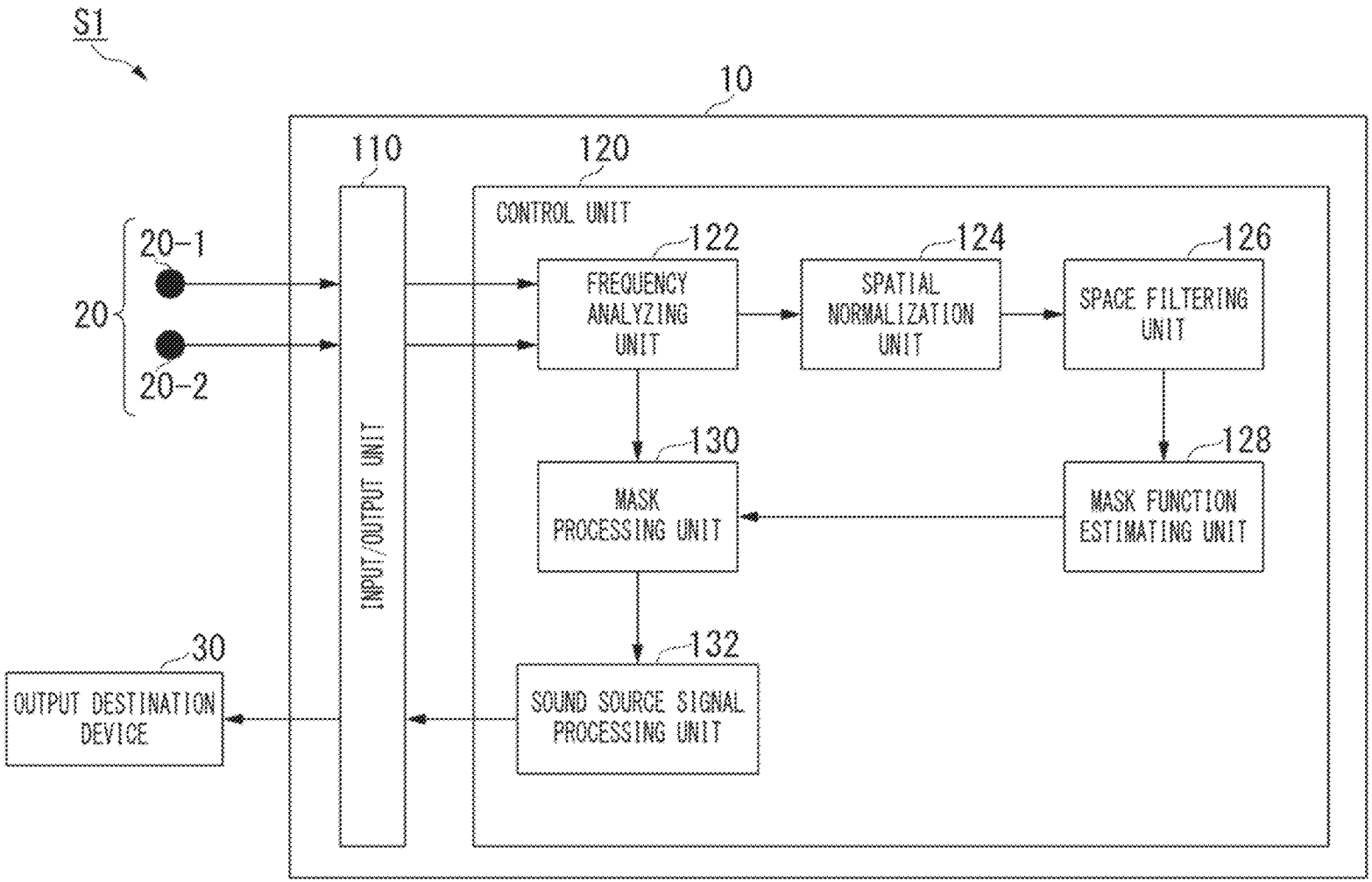
FIG. 1 is a block diagram illustrating a configuration example of an acoustic processing system according to this embodiment.

FIG. 1 is a block diagram illustrating a configuration example of an acoustic processing system S1 according to this embodiment.

The acoustic processing system S1 includes an acoustic processing device 10 and a sound receiving unit 20.

The acoustic processing device 10 determines a spectrum of acoustic signals of a plurality of channels acquired from the sound receiving unit 20. The acoustic processing device 10 determines a normalized spectrum by normalizing an orientation component for a target direction of the sound receiving unit 20 that is included in a spectrum determined for each channel into an orientation component for a predetermined standard direction. The acoustic processing device 10 determines a mask function used for extracting a component arriving from the target direction on the basis of a normalized spectrum determined using a machine learning model for each channel. The acoustic processing device 10 estimates a component of a target sound source installed in the target direction by applying the mask function determined for each channel to an acoustic signal. The acoustic processing device 10 outputs an acoustic signal representing the estimated component of the target sound source to an output destination device 30. The output destination device 30 is another device that is an output destination of an acoustic signal.

The sound receiving unit 20 has a plurality of microphones and is formed as a microphone array. Individual microphones are present at different positions and receive sound waves arriving at own units thereof. In the example illustrated in FIG. 1, individual microphones are identified using 20-1, 20-2, and child numbers. Each of the individual microphones includes an actuator that converts a received sound wave into an acoustic signal and outputs the converted acoustic signal to the acoustic processing device 10. In this embodiment, a unit of an acoustic signal received by each microphone will be referred to as a channel. In examples illustrated in FIGS. 3 and 4, two microphones are fixed to a casing having a rotary ellipse shape in the sound receiving unit 20. The microphones 20-1 and 20-2 are installed on an outer edge of a transverse section A-A' traversing a center axis C of the casing. An intersection between the center axis C and the transverse section A-A' is set as a representative point O. In this example, an angle formed by a direction of the microphone 20-1 from the representative point O and a direction of the microphone 20-2 is 135°.

Figure 3:
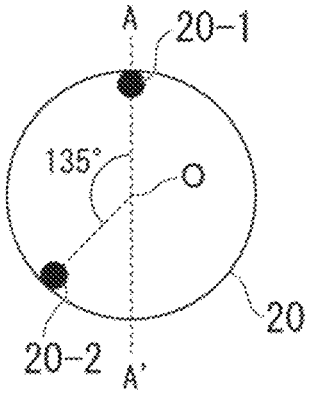
FIG. 3 is a topography illustrating an example of a sound receiving unit according to this embodiment.
Figure 4:
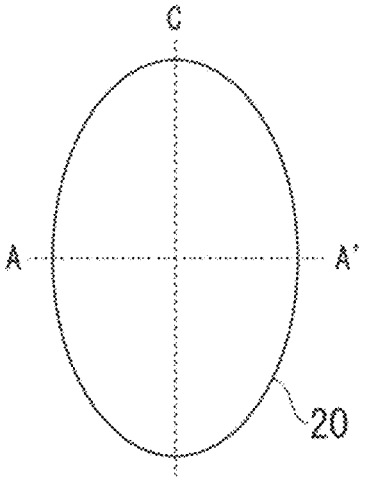
FIG. 4 is a side view illustrating an example of a sound receiving unit according to this embodiment.

In description here, as illustrated in FIGS. 1 and 3, a case in which the number of microphones is two will be mainly described. One microphone 20-1 and the other microphone 20-2 may be referred to as microphones 20-1 and 20-2.

The number of microphones may be three or more. The positions of the microphones are not limited to the illustrated example. Positional relations between a plurality of microphones may be fixed or changeable.

Next, a functional configuration example of the acoustic processing device 10 according to this embodiment will be described.

The acoustic processing device 10 is configured to include an input/output unit 110 and a control unit 120.

The input/output unit 110 is connected to other devices in a wireless manner or a wired manner such that it is able to input/output various kinds of data. The input/output unit 110 outputs input data input from other devices to the control unit 120. The input/output unit 110 outputs output data input from the control unit 120 to other devices. The input/output unit 110, for example, may be any one of an input/output interface, a communication interface, and the like or a combination thereof. The input/output unit 110 may include both or one of an analog-to-digital (A/D) converter and a digital-to-analog (D/A) converter. The A/D converter converts an analog acoustic signal input from the sound receiving unit 20 into a digital acoustic signal and outputs the converted acoustic signal to the control unit 120. The D/A converter converts a digital acoustic signal input from the control unit 120 into an analog acoustic signal and outputs the converted acoustic signal to the output destination device 30.

The control unit 120 performs a process for realizing the function of the acoustic processing device 10, a process for controlling the function thereof, and the like. The control unit 120 may be configured using a dedicated member or may be configured to include a processor such as a central processing unit (CPU) and various types of storage media. The processor reads a predetermined program stored in a storage medium in advance and performs a process instructed in accordance with various commands described in the read program, thereby realizing the process of the control unit 120.

The control unit 120 is configured to include a frequency analyzing unit 122, a spatial normalization unit 124, a space filtering unit 126, a mask function estimating unit 128, a mask processing unit 130, and a sound source signal processing unit 132.

The frequency analyzing unit 122 determines a spectrum by performing a frequency analysis of acoustic signals input from individual microphones for each frame of a predetermined time interval (for example, 10 to 50 msec). The frequency analyzing unit 122, for example, performs a discrete Fourier transform (DFT) in a frequency analysis. A spectrum of a frame t of an acoustic signal of a channel k is represented using a vector $x_{w,t}$ including a complex number $x_{k,w,t}$ for a frequency w as an element. This vector is called an observed spectrum vector. The observed spectrum vector $x_{w,t}$ is represented as $[x_{k1,w,t}, x_{k2,w,t}]^T$. Here, T represents a transposition of a vector or a matrix. An element of an observed spectrum vector $x_{w,t}$, for example, $x_{k1,w,t}$ may be referred to as an "observed spectrum". The frequency analyzing unit 122 outputs a spectrum of each channel to the spatial normalization unit 124 for each frame. The frequency analyzing unit 122 outputs an observed spectrum (for example, $x_{k1,w,t}$) of a predetermined channel to the mask processing unit 130 for each frame.

The spatial normalization unit 124 generates a normalized spectrum by performing normalization (spatial normalization) of an observed spectrum input from the frequency analyzing unit 122 such that an orientation component of the sound receiving unit 20 for the target direction included in the spectrum is converted into an orientation component for a predetermined standard direction. The target direction corresponds to a direction of a sound source from a reference position using the position of the sound receiving unit 20 as the reference position. The standard direction corresponds to a direction (for example, a forward direction) that becomes a predetermined reference which is determined in advance from a reference position. The orientation component of the sound receiving unit 20 can be controlled using a steering vector. The steering vector is a vector including a complex number representing a gain and a phase for each channel as element values. The steering vector is determined for each orientation direction and has directivity for which a gain for the orientation direction is higher than gains for the other directions as an orientation solution for the orientation direction. For an element value of a steering vector for the target direction for each channel, a weighted addition value of an acoustic signal having the element value as a weighting coefficient is used for calculating an array output as a microphone array. A gain of the array output for the target direction is higher than gains for the other directions. The steering vector is configured to include element values acquired by normalizing transfer functions from a sound source to microphones corresponding to individual channels. A transfer function may be an actually measured value in a used environment or may be a calculation value calculated through a simulation assuming a physical model. The physical model may be a mathematical model that provides acoustic transfer characteristics from a sound source to a sound reception point at which a microphone is installed.

The spatial normalization unit 124, for example, can determine a normalized spectrum vector x'w,t using Equation (1) for the spatial normalization.

[Math 1]

$$x'_{w,t}=x_{w,t}\otimes a_w(r')\oslash a_w(r_{c,t}) \tag{1}$$

In Equation (1), $a_w(r')$ and $a_w(r_{c,t})$ respectively represent a steering vector for the standard direction r' and a steering vector for the target direction $r_{c,t}$. A symbol acquired by combining a mark "x" with a mark "o" represents multiplication between a vector therebefore and a vector thereafter for each element. A symbol acquired by combining a mark "/" with a mark "o" represents division of a vector therebefore by a vector thereafter for each element.

The steering vector $a_w(r_{c,t})$, for example, is represented as $[a_{k1,w}(r_{c,t}), a_{k2,w}(r_{c,t})]^T$. $a_{k1,w}(r_{c,t})$ and $a_{k2,w}(r_{c,t})$ respectively represent transfer functions from a sound source installed in the target direction to the microphones 20-1 and 20-2. Here, each of the steering vectors $a_w(r_{c,t})$ and $a_w(r')$ is normalized such that norm $\|a_w(r_{c,t})\|$ becomes 1. The spatial normalization unit 124 outputs the determined normalized spectrum $x'_{w,t}$ to the space filtering unit 126.

The space filtering unit 126 determines a corrected spectrum $z_{w,t}$ by applying a space filter representing directivity for the target direction $r_{c,t}$ to the normalized spectrum $x'_{w,t}$ input from the spatial normalization unit 124. As the space filter, a vector or a matrix having filter coefficients causing directivity for the target direction $r_{c,t}$ as elements may be used. As such a filter, for example, a delay-and-sum beamformer (DS beamformer) may be used. A space filter based on the steering vector $a_w(r_{c,t})$ for the target direction $r_{c,t}$ may be used. As represented in Equation (2), the space filtering unit 126 can determine a space correction spectrum $z_{w,t}$ using the DS beamformer for the normalized spectrum $x'_{w,t}$.

[Math 2]

$$z_{w,t}=[x_{w,t}^T, a_w(r_{c,t})^H x_{w,t}]^T \tag{2}$$

In Equation (2), $a_w(r_{c,t})$ represents a steering vector for the target direction $r_{c,t}$. H represents a conjugation of a vector or a matrix. The space filtering unit 126 outputs the determined correction spectrum $z_{w,t}$ to the mask function estimating unit 128.

The corrected spectrum $z_{w,t}$ determined on the basis of the normalized spectrum $x'_{w,t}$ is input to the mask function estimating unit 128. The mask function estimating unit 128 calculates a mask function $m_{w,t}$ for a frequency w and a frame t as an output value and calculates the corrected spectrum $z_{w,t}$ for the frequency w and the frame t as an input value using a predetermined machine learning model. The mask function $m_{w,t}$ is represented as a real number or a complex number of which an absolute value is normalized into a domain equal to or larger than 0 and equal to or smaller than 1. As the machine learning model, for example, various neural networks (NN) may be used. The neural network may be any one of types such as a convolutional neural network, a recurrent neural network, a feed forward neural network, and the like. The machine learning model is not limited to a neural network and may use any one of techniques of a decision tree, a random forest, correlation rule learning, and the like. The mask function estimating unit 128 outputs the calculated mask function $m_{w,t}$ to the mask processing unit 130.

The mask processing unit 130 estimates a spectrum (in description here, it may be referred to as a "target spectrum) $y'_{w,t}$ of a component of a target sound source installed in the target direction (in description here, it may be referred to as a "target component") by applying the mask function $m_{w,t}$ input from the mask function estimating unit 128 to a spectrum of an acoustic signal input from the frequency analyzing unit 122, that is, the observed spectrum $x_{k1,w,t}$. The mask processing unit 130, for example, as represented in Equation (3), calculates a target spectrum $y'_{w,t}$ by multiplying the observed spectrum $x_{k1,w,t}$ by the mask function $m_{w,t}$. The mask processing unit 130 outputs the calculated target spectrum $y'_{w,t}$ to the sound source signal processing unit 132.

[Math 3]

$$y'_{w,t}=m_{w,t}x_{k1,w,t} \tag{3}$$

The sound source signal processing unit 132 generates a sound source signal of a target sound source component of the time domain by performing an inverse discrete Fourier transform (IDFT) for the target spectrum $y'_{w,t}$ input from the mask processing unit 130. The sound source signal processing unit 132 outputs the generated sound source signal to the output destination device 30 through the input/output unit 110. The sound source signal processing unit 132 may store the generated sound source signal in a storage unit (not illustrated in the drawing) of its own device. The output destination device 30 may be an acoustic device such as a speaker or may be an information device such as a personal computer or a multi-function mobile phone.

(Observation Model)

Next, an observation model that is a premise of this embodiment will be described. The observation model is a model that formulates an observed spectrum of a sound wave arriving at the sound receiving unit 20 from a sound source installed in an acoustic space. In a case in which M (here, M is an integer that is two or more) sound sources are installed at different positions $r_{m,t}$ in an acoustic space, an observed spectrum $x_{w,t}$ of an acoustic signal received by individual microphones composing the sound receiving unit 20 is formulated using Equation (4).

[Math 4]

$$x_{w,t} = \sum_{m=1}^{M} h_w(r_{m,t}) s_{m,w,t} + n_{w,t} \tag{4}$$

In Equation (4), m represents an index that represents each sound source. $s_m$ represents a spectrum of an acoustic signal output by a sound source m. $h_w(r_{m,t})$ represents a transfer function vector. The transfer function vector $h_w(r_{m,t})$ is a vector $[h_{k1,w}(r_{m,t}), h_{k2,w}(r_{m,t})]^T$ including transfer functions from sound sources installed at sound source positions $r_{m,t}$ to individual microphones as elements. $n_{w,t}$ represents a noise vector. The noise vector $n_{w,t}$ is a vector $[n_{k2,w,t}, n_{k2,w,t}]^T$ including noise components included in an observed spectrum observed by individual microphones as elements. Equation (4) represents that a sum of a total sum of products of spectrums $s_m$ of acoustic signals output by individual sound sources m and transfer functions $h_w(r_{m,t})$ among sound sources and a noise spectrum $n_{w,t}$ is the same as the observed spectrum $x_{w,t}$. In description here, a sound source signal generated by a sound source and a spectrum thereof may be respectively referred to as a "sound source signal" and a "sound source spectrum".

According to this model, a target spectrum $y_{w,t}$ based on the target sound source c installed in the target direction $r_{c,t}$, as represented in Equation (5), is represented as a product between the transfer function $h_{k1,w}(r_{c,t})$ from a target sound source c to a predetermined microphone (for example, a microphone 20-1) and the sound source spectrum $s_{c,w,t}$ of the target sound source c. The acoustic processing device according to this embodiment has a configuration for estimating the component of the target sound source c included in the observed spectrum $x_{w,t}$ as the target spectrum $y_{w,t}$ as described above.

[Math 5]

$$y_{w,t}=h_{k1,w}(r_{c,t})s_{c,w,t} \tag{5}$$

(Spatial Normalization)

Next, spatial normalization will be described. The spatial normalization corresponds to conversion of an orientation component of the sound receiving unit 20 for the target direction that is included in an observed spectrum into an orientation component for a predetermined standard direction.

Figure 2:
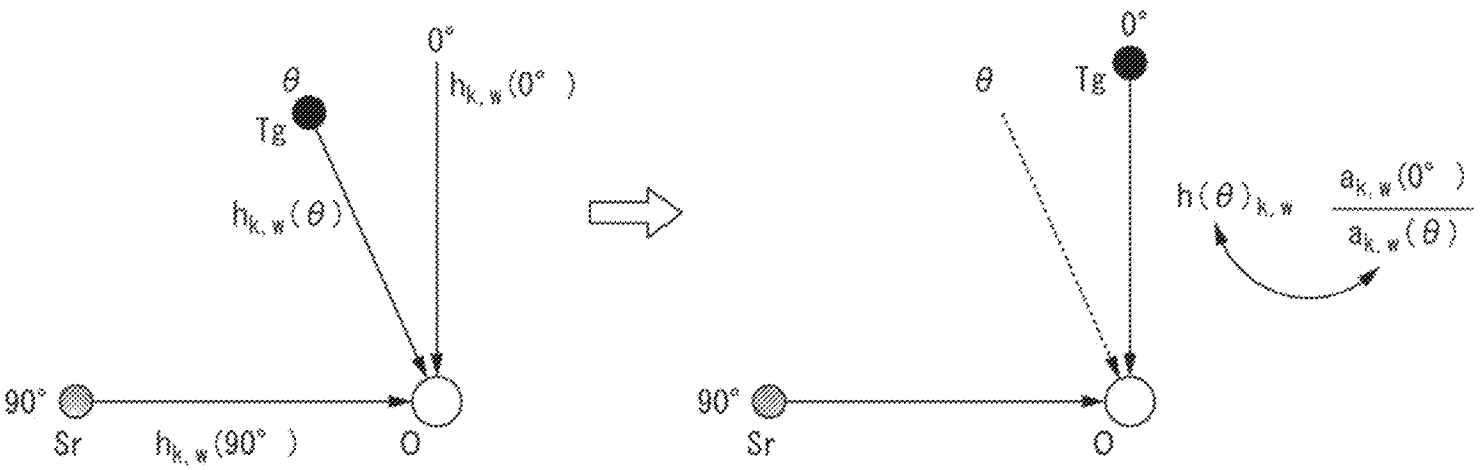
FIG. 2 is an explanatory diagram illustrating spatial normalization.

FIG. 2 illustrates a case in which, when one sound source out of two sound sources is set as a target sound source Tg and the other sound source is set as the other sound source Sr, an orientation component of the target sound source Tg for a target direction θ is converted into an orientation component for a standard direction 0°. Here, a representative point of the sound receiving unit 20 is set as an origin O, and a sound source direction of each sound source is represented using an azimuth angle formed with a standard direction 0° from the origin. The azimuth angle is set in a counterclockwise direction using the standard direction as a reference.

In such a case, spectrums of components arriving from a sound source installed in a target direction θ and the standard direction 0° are respectively in proportion to transfer functions $h_{k,w}(\theta)$ and $h_{k,w}(0°)$ relating to the respective directions. In this embodiment, as an orientation component in spatial normalization, a ratio $a_{k,w}(0°)/a_{k,w}(\theta)$ of the steering vector $a_{k,w}(0)°$ to the steering vector $a_{k,w}(\theta)$ is multiplied. Since a steering vector is in proportion to a transfer function from a sound source to a microphone, the transfer function $h_{k,w}(\theta)$ and the steering vector $a_{k,w}(\theta)$ offset each other, and a component that is in proportion to the steering vector $a_{k,w}(0)°$, that is, the transfer function $h_{k,w}(0)°$ remains.

As described above, as a steering vector, a transfer function measured in advance or a transfer function composed using a physical model is used. In contrast to this, in an actual sound field, a transfer function varies in accordance with an environment, and thus the transfer function $h_{k,w}(\theta)$ and the steering vector $a_{k,w}(\theta)$ do not completely offset each other. However, differences in the intensity and the phase based on a difference in the position of each microphone are reflected in the steering vector, and dependency according to a sound source position remains in the steering vector. According to the spatial normalization, the transfer function $h_{k,w}(\theta)$ and the steering vector $a_{k,w}(\theta)$ partially offset each other, and the dependency of the transfer function $h_{k,w}(\theta)$ on a sound source direction is alleviated.

(Model Learning)

Next, learning of a parameter set of a machine learning model used by the mask function estimating unit 128 will be described. As described above, the mask function estimating unit 128 calculates the mask function $m_{w,t}$ as an output value and calculates the correction spectrum $z_{w,t}$ as an input value using the machine learning model. For this reason, a parameter set of the machine learning model is set in the mask function estimating unit 128 in advance. The acoustic processing device 10 may include a model learning unit (not illustrated) used for determining a parameter set using training data.

The model learning unit determines a parameter set of a machine learning model such that a residual between an estimated value of a component of a target sound source, which is acquired by applying a mask function to an acoustic signal representing a sound in which components arriving from a plurality of sound sources including the target sound source are mixed, and a target value of the component of the target sound source is small. As the target value, an acoustic signal representing a sound that arrives from the target sound source and does not include components from other sound sources is used.

Thus, the model learning unit configures training data including a plurality of (typically, 100 to 1000 or more) data sets that are pairs of a known input value and an output value corresponding to the input value. The model learning unit calculates an estimated value of an output value from an input value included in each data set using the machine learning model. The model learning unit repeats a process of updating the parameter set such that a loss function representing a magnitude of a difference (estimated error) between an estimated value calculated for each data set and an output value included in the data set further decreases in model learning. The parameter set Θ is determined for each piece of training data of one set. The training data of one set is determined for a group of observed spectrum vectors $x_{w,t}$ of one set and sound source directions $r_{c,t}$ of one set. Each data set is acquired using a sound source signal of one frame. Frames of a sound source signal used for individual data sets may be consecutive in time or may be intermittent.

As an input value for a machine learning model, a corrected spectrum $z_{w,t}$ that is an input value is given from the observed spectrum vector $x_{w,t}$ using the technique described above. The observed spectrum vector $x_{w,t}$ is acquired by producing sounds from a plurality of sound sources of which positions are different from each other and performing a frequency analysis of acoustic signals received by individual microphones composing the sound receiving unit 20.

A target spectrum $y_{w,t}$ that is an output value for the machine learning model is acquired by performing a frequency analysis of an acoustic signal received from at least one microphone of the sound receiving unit 20 in a case in which a sound is produced from a target sound source that is one of a plurality of sound sources and no sound is produced from the other sound sources. Here, as the target sound source, a sound source signal used at the time of acquiring an input value and a sound based on a common sound source signal are reproduced.

An acoustic signal used for acquiring an input value and an output value may not be necessarily an acoustic signal received using a microphone but may be composed through a simulation. For example, in a simulation, a convolution operation is performed for a sound source signal using an impulse response representing a transfer characteristic from a position of each sound source to each microphone, and an acoustic signal representing a component arriving from the sound source can be generated. Thus, an acoustic signal representing sounds from a plurality of sound sources is acquired by adding components of the individual sound sources. As an acoustic signal representing a sound from a target sound source, an acoustic signal representing a component of the target sound source may be employed.

The model learning unit determines whether or not a parameter set converges on the basis of whether or not an update amount that is a difference between before/after update of the parameter set is equal to or smaller than a predetermined threshold of the update amount. The model learning unit continues the process of updating the parameter set until it is determined that the parameter set converges. The model learning unit, for example, uses L1 norm represented in Equation (6) as a loss function G(Θ).

[Math 6]

$$G(\Theta) = \sum_{w,t} \left| \log|y_{w,t}| - \log|y'_{w,t}| \right| \tag{6}$$

Equation (6) represents that a total sum of respective differences of a logarithmic value of the amplitude of a target spectrum $y'_{w,t}$, which is an estimated value, from a logarithmic value of the amplitude of a known target spectrum $y_{w,t}$, which is an output value, among frequencies and sets (frames) is given as a loss function G(Θ). By taking the logarithmic values of the target spectrums $y_{w,t}$ and $y'_{w,t}$, a difference in the domain of the amplitude that may be markedly different for each frequency can be alleviated. This is convenient for performing batch processing between frequencies. The model learning unit may omit the determination of convergence of the parameter set and repeat the process of updating the parameter set a number of times set in advance.

In the example described above, although a case in which the mask function estimating unit 128 and the model learning unit use the corrected spectrum $z_{w,t}$ as an input value for the machine learning model has been described as an example, the normalized spectrum $x'_{w,t}$ may be used as it is. In such a case, the mask function estimating unit 128 can determine the target spectrum $y'_{w,t}$ as an output value for the normalized spectrum $x'_{w,t}$ that is an input value. In such a case, the space filtering unit 126 may be omitted.

The space filtering unit 126 may determine a corrected spectrum $z_{w,t}$, as represented in Equation (7), using a space filter matrix $W_w^H$ and a bias vector $b_w$ as a space filter instead of the DS beamformer.

[Math 7]

$$z_{w,t}=W_w^H x'_{w,t}+b_w \tag{7}$$

The space filter matrix $W_w$ is configured by arranging J (here, J is an integer equal to or larger than 1 set in advance) filter coefficient vectors $w_{j,w}$ in each column. Here, j is an integer equal to or larger than 1 and equal to or smaller than J. In other words, the space filter matrix $W_w$ is represented as $[w_{1,w}, \ldots, w_{J,w}]$. Each filter coefficient vector $w_{j,w}$ corresponds to one beamformer and represents directivity for a predetermined direction. The norm the individual filter coefficient vector $w_{j,w}$ is normalized to 1. Thus, Equation (7) represents that a corrected spectrum $z_{w,t}$ is calculated by adding a bias vector $b_w$ to a product acquired by multiplying a normalized spectrum $x'_{w,t}$ by a space filter matrix $W_w^H$. The mask function estimating unit 128 can calculate a mask function $m_{w,t}$ as an output value using the corrected spectrum $z_{w,t}$ calculated by the space filtering unit 126 or the absolute value $|z_{w,t}|$ thereof as an input value by using the machine learning model.

In addition, the model learning unit may simultaneously solving the space filter matrix $W_w$ representing the space filter and the bias vector $b_w$ in addition to the parameter set of the machine learning model such that estimated error of the target spectrum $y_{w,t}$ for each target sound source decreases. As described above, the corrected spectrum $z_{w,t}$ is calculated using the space filter matrix $W_w$ and the bias vector $b_w$ for the normalized spectrum $x'_{w,t}$. An estimated value $y'_{w,t}$ of the target spectrum is calculated on the basis of the calculated corrected spectrum $z_{w,t}$ additionally using the parameter set of the machine learning model.

In the embodiment described above, although a case in which the target direction is determined in advance has been premised, the configuration is not limited thereto. The acoustic processing device 10 may include a sound source direction estimating unit (not illustrated) for estimating a sound source direction using an acoustic signal of each channel. The sound source direction estimating unit outputs target direction information representing the determined sound source direction as a target direction to the spatial normalization unit 124 and the space filtering unit 126. Each of the spatial normalization unit 124 and the space filtering unit 126 can identify a target direction using the target direction information input from each sound source direction estimating unit.

The sound source direction estimating unit, for example, can estimate a sound source direction using a multiple signal classification (MUSIC) method. The MUSIC method is a technique for calculating a ratio of the absolute value of a transfer function vector to a residual vector acquired by subtracting a component of a meaningful unique vector from the transfer function vector as a space spectrum and determining a direction for which power of the space spectrum for each direction is higher is than a predetermined threshold and is a maximum as a sound source direction. The transfer function vector is a vector having transfer functions from a sound source to individual microphones as elements.

The sound source direction estimating unit may estimate sound source direction using any other technique, for example, a weighted delay and sum beam forming (WDS-BF) method. The WDS-BF method is a technique for calculating a square value of a delayed sum of acoustic signals $\xi_q$ of all the bands of each channel as a power of a space spectrum and searching for a sound source direction for which the power of the space spectrum is higher than a predetermined threshold and is a maximum.

The sound source direction estimating unit can determine sound source directions of a plurality of sound sources at the same time using the technique described above. In the process thereof, the number of meaningful sound sources is detected.

The space filter matrix $W_w$ and the bias vector $b_w$ may be set for every filter number J in the space filtering unit 126. The model learning unit may set model learning such that the filter number J is equal to or larger than the number of sound sources and determine the space filter matrix $W_w$ and the bias vector $b_w$. The space filtering unit 126 may identify the number of sound sources on the basis of sound source directions of the sound sources represented in the sound source direction information input from the sound source direction estimating unit and select space filter matrixes $W_w$ and bias vectors $b_w$ corresponding to the filter number J that is the same as the identified number of sound sources or is larger than the number of the sound sources. As the whole space filter, the directivity covers the sound source directions of all the sound sources, and thus even when the number of sound sources is increased, a stable corrected spectrum can be acquired.

As described above, the mask processing unit 130 sets each of a plurality of detected sound sources as a target sound source and calculates a target spectrum $y'_{w,t}$ using the mask function $m_{w,t}$ having the direction thereof as a target direction. The sound source signal processing unit 132 generates a sound source signal of a target sound source component from the target spectrum $y'_{w,t}$. The sound source signal processing unit 132 may output sound source direction information representing the sound source directions estimated by the sound source direction estimating unit on a display unit included in its own device or the output destination device 30, and one sound source among a plurality of sound sources may be selectable in accordance with an operation signal input from the operation input unit. The display unit, for example, is a display. The operation input unit, for example, is a pointing device such as a touch sensor, a mouse, a button, or the like. The sound source signal processing unit 132 may output a sound source signal of a target sound source component having the selected sound source as a target sound source and stop output of other sound source signals.

In the example described above, although a case in which the mask function $m_{w,t}$ is a scalar value of which the number of elements is one is assumed, but the mask function may be a vector of which the number of elements is two or more. In such a case, the mask processing unit 130 may calculate a total sum of products acquired by respectively multiplying observed spectrums $x_{k,w,t}$ of a plurality of channels by mask functions $m_{k,w,t}$ of the corresponding channels as a target spectrum $y'_{w,t}$. Here, a machine learning model generated by calculating the target spectrum $y'_{w,t}$ using a similar technique in model learning is set in the mask function estimating unit 128.

(Acoustic Processing)

Figure 5:
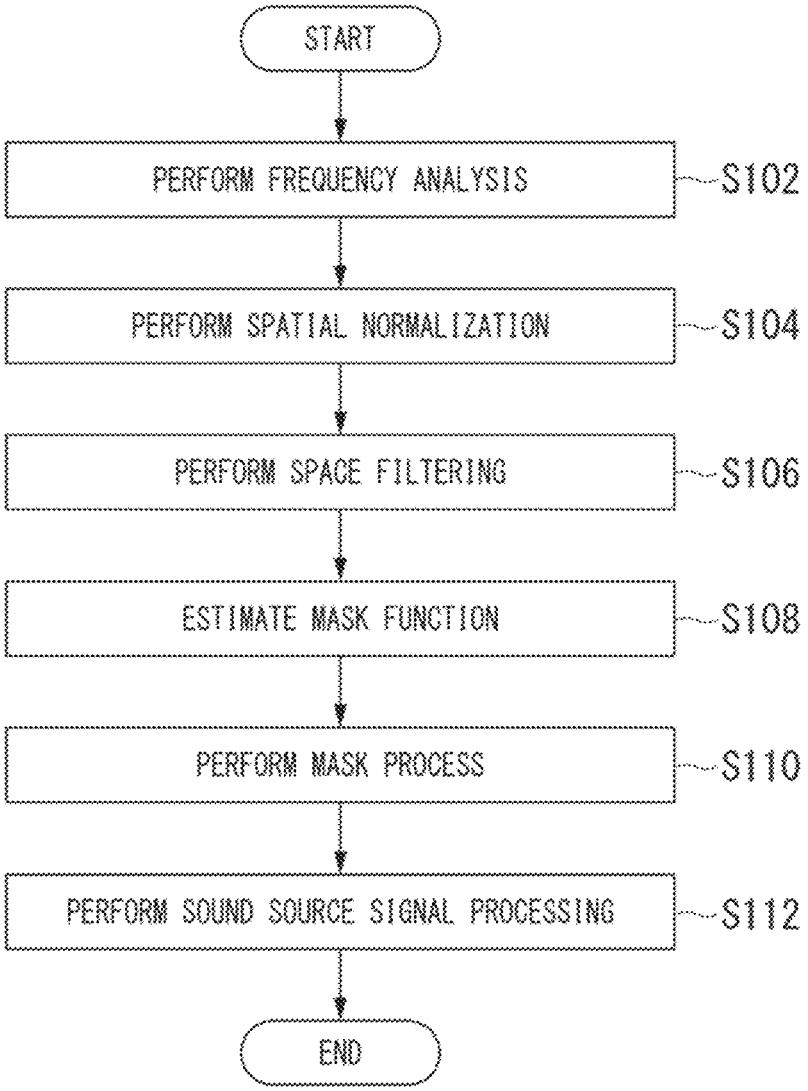
FIG. 5 is a flowchart illustrating an example of acoustic processing according to this embodiment.

Next, an example of the acoustic processing according to this embodiment will be described. FIG. 5 is a flowchart illustrating an example of acoustic processing according to this embodiment.

(Step S102) The frequency analyzing unit 122 determines an observed spectrum by performing a frequency analysis on an acoustic signal of each channel input from each microphone for each frame.

(Step S104) The spatial normalization unit 124 determines a normalized spectrum by performing spatial normalization such that an orientation direction of the sound receiving unit 20 for a target direction included in the observed spectrum is converted into an orientation direction for a predetermined standard direction.

(Step S106) The space filtering unit 126 determines a corrected spectrum by applying a space filter for the target direction to the normalized spectrum.

(Step S108) The mask function estimating unit 128 determines a mask function using the corrected spectrum as an input value by using the machine learning model.

(Step S110) The mask processing unit 130 determines a target spectrum by applying the mask function to the observed spectrum of a predetermined channel.

(Step S112) The sound source signal processing unit 132 generates a sound source signal of the target sound source component of the time domain on the basis of the target spectrum. Thereafter, the process illustrated in FIG. 5 ends.

(Model Learning)

Figure 6:
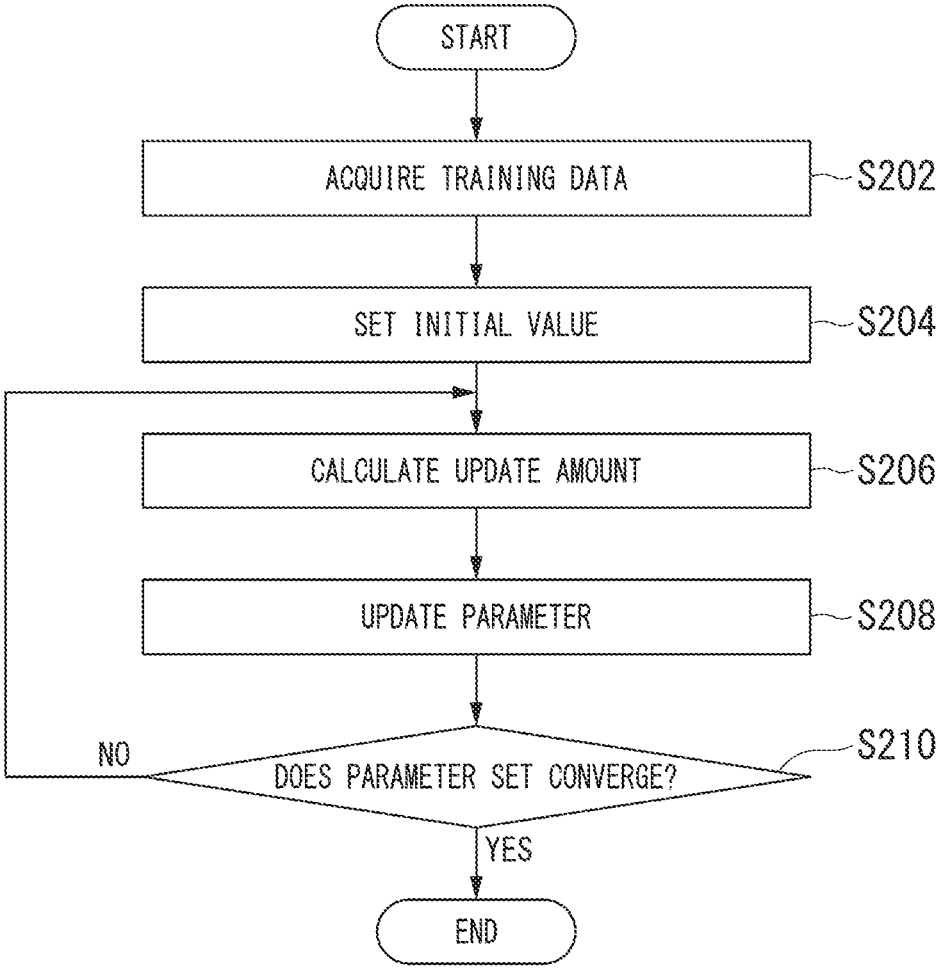
FIG. 6 is a flowchart illustrating an example of model learning according to this embodiment.

Next, an example of the model learning according to this embodiment will be described. FIG. 6 is a flowchart illustrating an example of the model learning according to this embodiment.

(Step S202) The model learning unit forms training data that includes a plurality of data sets including a corrected spectrum based on the normalized spectrum for each frame according to a plurality of sound sources as an input value and a target spectrum according to the target sound source as an output value.

(Step S204) The model learning unit sets initial values of the parameter set. In a case in which model learning was performed in the past, the model learning unit may set a parameter set acquired through past model learning as initial values.

(Step S206) The model learning unit determines an update amount of the parameter set for further decreasing the loss function using a predetermined parameter estimation method. As the parameter estimation method, for example, one technique of a back propagation method, a steepest descent method, a stochastic gradient descent method, and the like can be used.

(Step S208) The model learning unit calculates the parameter set after update by adding a determined update amount to the original parameter set (parameter update).

(Step S210) The model learning unit determines whether or not the parameter set has converged on the basis of whether the update amount is equal to or smaller than a threshold of a predetermined update amount. When it is determined that the parameter set has converged (Step S210: Yes), the process illustrated in FIG. 6 ends. The model learning unit sets the acquired parameter set in the mask function estimating unit 128. When it is determined that the parameter set has not converged (Step S210: No), the process is returned to the process of Step S206.

In the description presented above, although a case in which the spatial normalization, the space filtering, the mask processing, the sound source signal processing, and the like accompany arithmetic operations in the frequency domain using the spectrum of the frequency domain has been mainly described, the configuration is not limited thereto. Signals of the time domain may be used in place of spectrums of the frequency domain. In such a case, a convolution operation and an inverse convolution operation in the time domain may be respectively performed in place of multiplication and division in the frequency domain. For example, the mask processing unit 130 may generate an acoustic signal representing a target component by performing convolution of a conversion coefficient of the mask function of the time domain with an acoustic signal from the sound receiving unit 20 in place of calculating the target spectrum $y'_{w,t}$ by multiplying the observed spectrum $x_{k1,w,t}$ by the mask function $m_{w,t}$. In such a case, a Fourier inverse transform in the sound source signal processing unit 132 and the frequency analyzing unit 122 may be omitted.

(Experiment)

Next, an experiment performed for evaluating validness of the acoustic processing device 10 will be described. In the experiment, sound sources of two types were used. One is a sound source signal representing a voice of a person, and the other is a sound source signal representing a non-voice. A spoken voice included in Corpus of Spontaneous Japanese (CSJ) was used as a voice of a person. A sound source signal used for a test set was selected from an official evaluation set that is set in CSJ. In the test set, sound source signals representing voices of 10 males and 10 females for 100 minutes are included as test signals. In each test, periods of test signals are in the range of 3 seconds to 10 seconds. As the non-voice, sound source signals selected from an RWCP real environment voice/acoustic database (Real World Computing Partnership Sound Scene Database in Real Acoustical Environments) are used as test sets. The RWCP real environment voice/acoustic database is a corpus including non-voice signals of about 60 kinds. For example, a breaking sound of glass, a sound of a bell, and the like are included therein. As training data, voices in presentations of scientific lectures for 223 hours were used. In the presentations of the scientific lectures, a sound source signal representing 799 male voices and 168 female voices is included.

In this experiment, acoustic signals of two channels (in the following description, they may be referred to as binaural signals) are composed as observed signals by performing convolution of impulse responses of two channels with the sound source signals. Each of the observed signals is used for generating training data and a test set. The impulse responses of the two channels were measured for each sound source direction in an anechoic chamber in advance using a sampling frequency of 16 kHz. In the measurement, a microphone array of two channels illustrated in FIGS. 3 and 4 was used. An impulse response represents transfer characteristics of a sound wave from a sound source to each microphone in the time domain.

Figure 7:
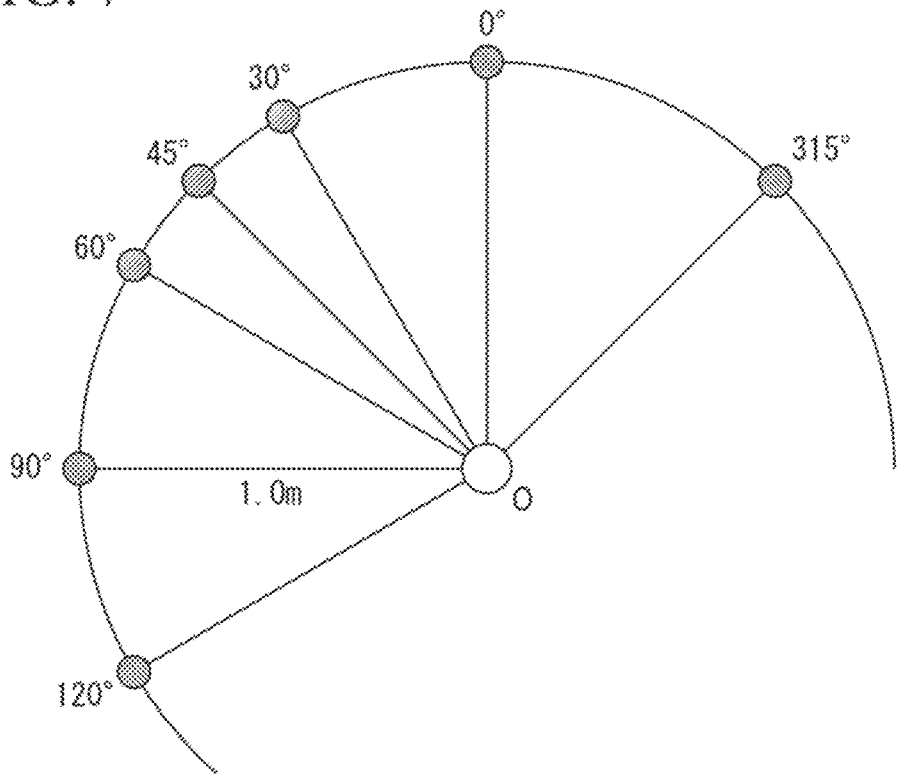
FIG. 7 is a plan view illustrating a positional relation between a microphone array and sound sources.

FIG. 7 is a plan view illustrating a positional relation between a microphone array (the sound receiving unit 20) and sound sources. As an origin O, a representative point of the microphone array is used, and a sound source direction can be set on the circumference having the origin O set as its center with a radius of 1.0 m in units of 1°. Here, in this experiment, two sound source Sr-1 and Sr-2 having different heights in the individual sound source directions were set.

Figure 8:
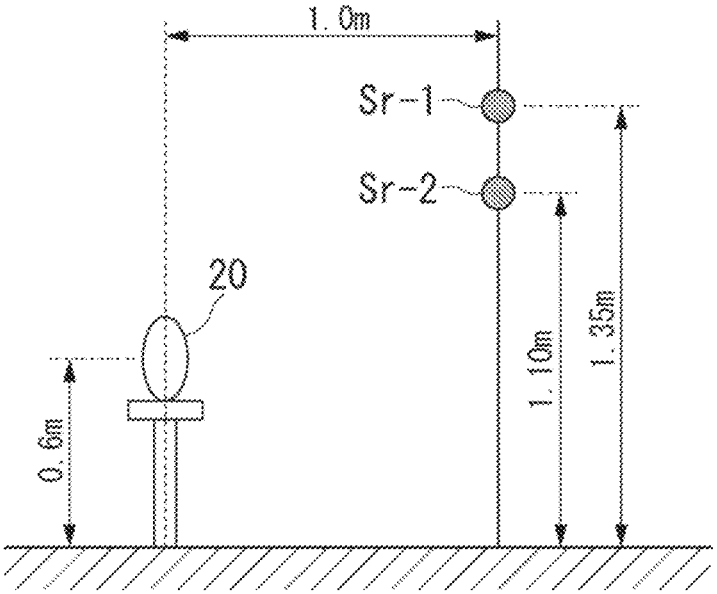
FIG. 8 is a side view illustrating a positional relation between a microphone array and sound sources.

FIG. 8 is a side view illustrating a positional relation between a microphone array (the sound receiving unit 20) and sound sources Sr-1 and Sr-2. While a height of a transverse section in which two microphones are arranged is 0.6 m from the floor, heights of the sound sources Sr-1 and Sr-2 are respectively 1.35 m and 1.10 m.

The sound sources Sr-1 and Sr-2 were used for generating different test sets 1 and 2. For the generation of training data, the sound source Sr-1 was used, and the sound source Sr-2 is not used. Thus, the test set 1 is a matched test set for which the same sound source Sr-1 as that of the training data is used. The test set 2 is an unmatched test set for which the sound source Sr-2 different from that of the training data is used.

As the training data, an acoustic signal in which voice signals of three speakers were mixed was used. Most of the acoustic signal is a voice signal of the same speaker. A target direction $\theta_{c,t}$ of one speaker was set to be time-invariant in accordance with elapse of time and is uniformly selected between 0° to 359°. Target directions of the other two speakers are randomly selected from ($\theta_{c,t}$+20+u°) and ($\theta_{c,t}$+340−u°). Here, u is an integer value that is randomly selected from integer values equal to or larger than 0 and equal to or smaller than 140.

As test sets, four kinds of data sets were used. The data sets of four kinds include a signal in which acoustic signals representing components from a plurality of sound sources are mixed as a test signal for each test. These signals are not included in any training data. The data sets of four kinds will be respectively referred to as a 2-voice (sp2) set, a 3-voice (sp3) set, a 2-voice+non-voice (sp2+n1) set, and a 4-voice (sp4) set. The 2-voice set includes a test signal in which voices of two persons are mixed. As patterns of sound source directions in each test included in the 2-voice set, patterns [0°, 30°], [0°, 45°], and [0°, 60°] of three kinds are included. The 3-voice set includes a test signal in which voices of three persons are mixed. As patterns of sound source directions in each test included in the 3-voice set, patterns [0°, 30°, 60°], [0°, 45°, 90°], and [0°, 60°, 120°] of three kinds are included. In the 2-voice+non-voice (sp2+n1) set, a test signal in which voices of two persons and one non-voice are mixed is included. As patterns of sound source directions for voices of two persons, patterns similar to those of the 2-voice set are used. As an acoustic signal representing the non-voice, the sound source signal thereof is used as it is. The 4-voice set includes a test signal in which voices of four persons are mixed. As a pattern of a sound source direction for the voices of four persons, a pattern [0°, 45°, 270°, 315°] of one kind is included. In any of the data sets, a standard direction in the spatial normalization is set to 0°. In a case in which the DS beamformer is used, the directivity thereof is constantly directed toward 0°. In a test set, an error of ±2° is included in the target direction.

For a comparison with this embodiment, as a baseline, evaluations were performed also for the following techniques of two kinds not accompanying spatial normalization. The techniques of two kinds will be respectively referred to as process A and process B. The process A is a technique for inputting the space corrected spectrum $z_{w,t}$ based on a DS beamformer generated in space filtering to a mask function with spatial normalization omitted. The process B is a technique for inputting a space corrected spectrum $z_{w,t}$ based on a space filter (an optimized beam (OptBeam)) acquired through learning to the mask function with spatial normalization omitted. In any one thereof, the target direction $\theta_{c,t}$ was set to be changeable, and a target sound source component was independently separated for each target sound source.

In this embodiment, evaluations were performed for the process A accompanying spatial normalization, the process B accompanying spatial normalization (J=2), the process B accompanying spatial normalization (J=3), and the process B accompanying spatial normalization (J=4) as four kinds.

In this experiment, a neural network was used as a machine learning model, and the setting thereof was configured to be common to the test sets in model learning, sound source separation, and sound source separation. The neural network includes a feature-extraction network and a fully connected network. The feature-extraction network includes mel-filter bank feature extraction and learned parameters using a back-propagation method.

In this experiment, a frame shift for each frame is set to 10 ms. In the feature-extraction network, functions of a discrete Fourier transform (a window function of 512 points), calculation of an absolute value, linear projection (a filter bank; 64 dimensions), calculation of an absolute value, calculation of power, frame concatenation, and linear projection (a bottle neck; 256 dimensions) are included in the mentioned order. The space filtering was applied to individual feature extraction streams. A period of an observation signal included in each data set forming training data was set to 640 ms. The fully connected network has seven layers and accompanies a Sigmoid function as an activation function. An output layer has 256-dimensional output nodes and accompanies a Sigmoid function used for outputting the mask function $m_{w,t}$.

In this experiment, a signal-to-distortion ratio (SDR) and a Cepstrum distortion (CD) were used as indexes of validness. The SDR is an index value of a degree of distortion of a target sound source component from a known reference signal. The SDR is an index value representing a higher degree of quality when the value thereof becomes larger. The SDR can be set using Equation (8).

[Math 8]

$$|y'_{w,t}|=\alpha|y_{w,t}|+|e_{w,t}| \tag{8}$$

Equation (8) represents that the amplitude of the target sound source component $y'_{w,t}$ is represented by a sum of a product of the amplitude of the reference signal $y_{w,t}$ and a parameter $\alpha$ and an error $e_{w,t}$. The parameter $\alpha$ is determined such that the error $e_{w,t}$ for each frequency w and each frame is minimized for each spectrum. In other words, the parameter $\alpha$ represents a degree of contribution of a reference signal to the target sound source component $y'_{w,t}$. The SDR corresponds to a logarithmic value of a total sum of power over the frequency w and the frame t for a ratio of the amplitude $\alpha|y_{w,t}|$ of the reference signal component to the amplitude $|e_{w,t}|$ of the error.

On the other hand, the CD is calculated using a Cepstrum coefficient acquired by performing a discrete cosine transform of a logarithmic amplitude spectrum. The CD represents higher quality when the value becomes smaller. In this experiment, the dimension of the Cepstrum coefficient is set from 1 to 24, and a distance value is calculated on the basis of the mean L1 norm (error absolute value).

As the SDR and the CD, values averaged over the target sound source components separated for individual test sets have been considered. In a case in which a plurality of sound sources are included in input data, target sound source components relating to each sound source were extracted from other sound sources using the target direction.

Next, results of the experiment will be described. FIG. 9 is a table illustrating qualities of extracted target sound source components. FIG. 9 represents an SDR and a CD for each technique and each test set. In each field, an SDR and a CD are respectively represented in an upper stage and a lower stage. Here, no processing represents an SDR and a CD for an observed signal acquired without performing any process. An underline represents the best performance for each test set. When the baseline and this embodiment are compared with each other, this embodiment can acquire better performance as a whole.

First, an SDR and a CD acquired by the process A according to the baseline are recognized to be more improved for any one of the test sets 1 and 2 than an SDR and a CD relating to no processing. However, the performance is meaningfully degraded in accordance with an increase in the number of sound sources, and the performance is degraded the most in a case in which a non-voice is mixed. This represents that it is difficult to separate a non-voice in the process A.

No improvement was recognized at all for a CDR and a CD relating to the process B over the CDR and the CD relating to no processing. As one factor, it is estimated that learning of the space filter has been unsuccessful.

An SDR and a CD acquired by the spatial normalization+process A according to this embodiment exhibit satisfactory performance also for any one of the test sets 1 and 2. For the test set 1, all the items are the best. Also for the test set 2, a CD for 3 sound sources and an SDR and a CD for each of 2 sound sources+non-voice, and 3 sound sources are the best. According to the spatial normalization+process A, improvement of about 1 to 3 dB is recognized for a CD over that of the process A according to the baseline. For the spatial normalization+process B, an SDR and a CD tend to be better in accordance with an increase in the filter number J. In the spatial normalization+process B (J=4), an SDR and a CD for the case of 2 voices and an SDR for three voices are the best. This represents that improvement of the performance is expected in accordance with an increase in the filter number J. For the spatial normalization+process B, the reasons for the performance being degraded in a case in which the filter number J is small are presumed to be excessive learning of training data and no use of constraints for learning. The excessive learning may cause directivity for a specific sound source direction to be marked and may be a factor disturbing acquisition of components of a target sound source having the specific direction as a target direction. As the constraints, for example, by using sparseness in an independent component analysis (ICA), improvement of the performance is expected.

Figure 10:
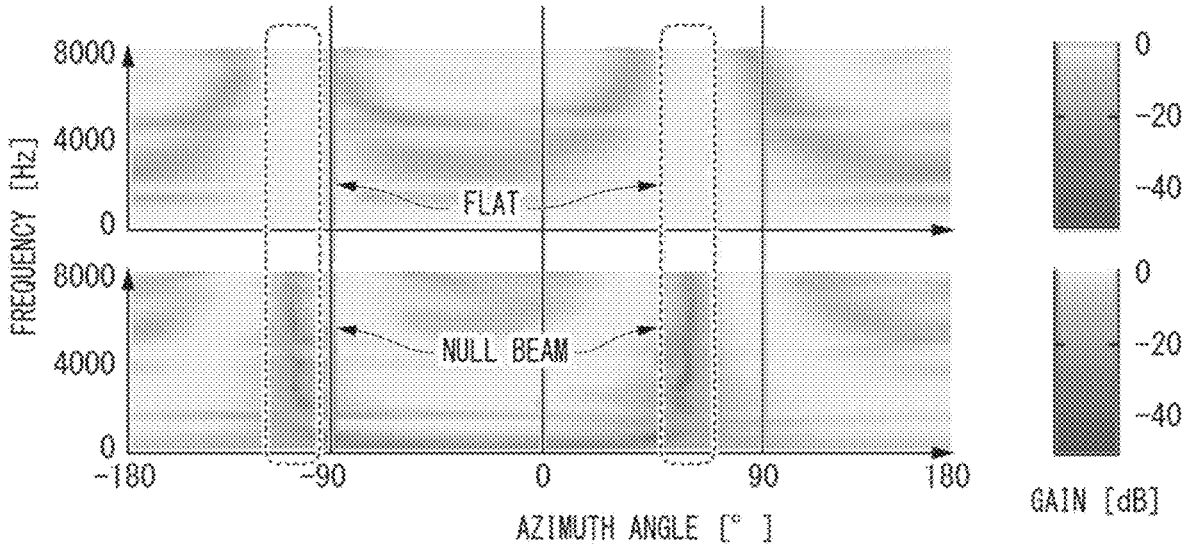
FIG. 10 is a diagram illustrating an example of amplitude responses of space filters.

The directivities of a plurality of space filters that have been learned have complementary beam patterns. The complementary beam patterns have a combination of a pattern having a flat gain and a null pattern having a lower gain for a certain direction than for the other directions. FIG. 10 illustrates amplitude responses of first and fourth channels respectively in first and second rows among four space filters acquired through learning. The vertical axis and the horizontal axis respectively represent a frequency and an azimuth angle of the sound source direction. A shade represents a gain. A darker part represents a higher gain, and a lighter part represents a lower gain.

In FIG. 10, while two null directions (blind spots) are recognized for the fourth filter, a null direction is not recognized in a direction corresponding to the first filter. This represents that even a target sound source having null directions of some of filters as the target direction on the basis of the complementary beam patterns, by using a plurality of filters, can acquire components of the target sound source without any omission using a neural network.

As described above, the acoustic processing device 10 according to this embodiment includes the spatial normalization unit 124 configured to generate a normalized spectrum by acquiring an acoustic signal from each of a plurality of microphones forming a microphone array and normalizing an orientation component of the microphone array for a target direction included in the spectrum of the acquired an acoustic signal into an orientation component for a predetermined standard direction. The acoustic processing device 10 includes the mask function estimating unit 128 configured to determine a mask function used for extracting a component of a target sound source arriving in the target direction on the basis of the normalized spectrum using a machine learning model. The acoustic processing device 10 includes the mask processing unit 130 configured to estimate the component of the target sound source installed in the target direction by applying the mask function to the acquired acoustic signal.

According to this configuration, the normalized spectrum used for estimating the mask function is normalized such that it includes an orientation component for the standard direction, and thus a machine learning model assuming all the sound source directions does not need to be prepared. For this reason, while the quality of the component of the target sound source acquired through sound source separation is secured, the space complexity of the acoustic environment in model learning can be reduced.

The spatial normalization unit 124 may use a first steering vector representing directivity for the standard direction and a second steering vector representing directivity for the target direction in the normalization.

According to this configuration, by using the first and second steering vectors that can be used also in the process of another microphone array starting from estimation of the direction of the sound source, spatial normalization can be realized by employing a simple process and a simple configuration.

The acoustic processing device 10 may further include a space filtering unit configured to generate a space correction spectrum by applying a space filter representing directivity for the target direction to the normalized spectrum. The mask function estimating unit 128 may determine the mask function by inputting the space correction spectrum to the machine learning model.

According to this configuration, the component of the target sound source installed in the target direction included in the acquired acoustic signal is reliably acquired, and thus the quality of the component of the estimated target sound source can be secured.

The acoustic processing device 10 may further include a model learning unit configured to determine a parameter set of the machine learning model such that a residual between an estimated value of the component of the target sound source acquired by applying the mask function to the acoustic signal representing sounds arriving from a plurality of sound sources including the target sound source and a target value of the component of the target sound source is small.

According to this configuration, a machine learning model used for determining a mask function for estimating the component of the target sound source by being applied to the acoustic signal can be learned.

The model learning unit may determine a space filter for generating a space correction spectrum from the normalized spectrum. The estimated value of the component of the target sound source may be acquired by applying the mask function to the space correction spectrum.

According to this configuration, a parameter set of the machine learning model and a space filter used for generating a space correction spectrum input to the machine learning model can be simultaneously solved and determined.

The acoustic processing device 10 may further include a sound source direction estimating unit configured to determine a sound source direction on the basis of a plurality of acoustic signals. The spatial normalization unit may determine the sound source direction determined by the sound source direction estimating unit as the target direction.

According to this configuration, even for a target sound source of which a target direction is unknown, the component of the target sound source can be estimated.

As above, although one embodiment of the present invention has been described in detail with reference to the drawings, a specific configuration is not limited to that described above, and various design changes and the like within a range not departing from the concept of the present invention can be performed.

As described above, the mask processing unit 130 sets each of a plurality of detected sound sources as a target sound source and calculates a target spectrum $y'_{w,t}$ using the mask function $m_{w,t}$ having the direction thereof as a target direction. The sound source signal processing unit 132 generates a sound source signal of a target sound source component from the target spectrum $y'_{w,t}$. The sound source signal processing unit 132 may output sound source direction information representing the sound source directions estimated by the sound source direction estimating unit on a display unit included in its own device or the output destination device 30, and one sound source among a plurality of sound sources may be selectable in accordance with an operation signal input from the operation input unit. The display unit, for example, is a display. The operation input unit, for example, is a pointing device such as a touch sensor, a mouse, a button, or the like. The sound source signal processing unit 132 may output a sound source signal of a target sound source component having the selected sound source as a target sound source and stop output of other sound source signals.

The acoustic processing device 10 may be configured as an acoustic unit integrated with the sound receiving unit 20. The positions of individual microphones composing the sound receiving unit 20 may be changeable. Each microphone may be installed in a mobile body. The mobile body may be any one of a cart, a flying object, and the like. In a case in which the positions of the individual microphones are changeable, the acoustic processing device 10 may be connected to a position detector that is used for detecting the positions of the individual microphones. The control unit 120 may determine a steering vector on the basis of the positions of the individual microphones.

Parts of the acoustic processing device 10 according to the embodiment, for example, some or all of the frequency analyzing unit 122, the spatial normalization unit 124, the space filtering unit 126, the mask function estimating unit 128, the mask processing unit 130, the sound source signal processing unit 132 may be configured to be realized using a computer. In such a case, they may be realized by recording a program used for realizing this control function on a computer-readable recording medium and causing a computer system including a processor to read and execute the program recorded on this recording medium.

A part or the whole of the acoustic processing device 10 according to the embodiment described above and a modified example may be realized as an integrated circuit such as a large scale integration (LSI). The functional blocks of the acoustic processing device 10 may be individually configured as processors, or some or all thereof may be integrated and configured as a processor. A technique for configuring an integrated circuit is not limited to the LSI but may be realized using a dedicated circuit or a general-purpose processor. In a case in which a technology for configuring an integrated circuit replacing the LSI appears in accordance with progress of the semiconductor technology, an integrated circuit according to this technology may be used.

What is claimed is:

1. An acoustic processing device comprising a processor and a memory storing a program which, when executed by the processor, causes the processor to function as:

a spatial normalization unit that generates a normalized spectrum by normalizing an orientation component of a microphone array for a target direction included in a spectrum of an acoustic signal acquired from each of a plurality of microphones forming the microphone array into an orientation component for a predetermined standard direction;

a mask function estimating unit that determines a mask function used for extracting a component of a target sound source arriving in the target direction on the basis of the normalized spectrum using a machine learning model;

a mask processing unit that estimates the component of the target sound source installed in the target direction by applying the mask function to the acoustic signal; and a space filtering unit that generates a space correction spectrum by applying a space filter representing directivity for the target direction to the normalized spectrum, wherein the mask function estimating unit determines the mask function by inputting the space correction spectrum to the machine learning model.

2. The acoustic processing device according to claim 1, wherein the spatial normalization unit uses a first steering vector representing directivity for the standard direction and a second steering vector representing directivity for the target direction in the normalization.

3. The acoustic processing device according to claim 1, wherein the processor is further comprising configured to function as a model learning unit that determines a parameter set of the machine learning model such that a residual between an estimated value of the component of the target sound source acquired by applying the mask function to the acoustic signal representing sounds arriving from a plurality of sound sources including the target sound source and a target value of the component of the target sound source is small.

4. The acoustic processing device according to claim 3, wherein the model learning unit determines the space filter for generating the space correction spectrum from the normalized spectrum, and wherein the estimated value of the component of the target sound source is acquired by applying the mask function to the space correction spectrum.

5. The acoustic processing device according to claim 1, wherein the processor is further configured to function as a sound source direction estimating unit that determines a sound source direction on the basis of a plurality of acoustic signals, wherein the spatial normalization unit uses the sound source direction as the target direction.

6. A computer-readable non-transitory storage medium storing a program thereon, the program causing a computer to function as the acoustic processing device according to claim 1.

7. An acoustic processing method comprising:

a first step of generating a normalized spectrum by normalizing an orientation component of a microphone array for a target direction included in a spectrum of an acoustic signal acquired from each of a plurality of microphones forming the microphone array into an orientation component for a predetermined standard direction;

a second step of determining a mask function used for extracting a component of a target sound source arriving in the target direction on the basis of the normalized spectrum using a machine learning model;

a third step of estimating the component of the target sound source installed in the target direction by applying the mask function to the acoustic signal; and a fourth step of generating a space correction spectrum by applying a space filter representing directivity for the target direction to the normalized spectrum, wherein determining the mask function estimating unit includes inputting the space correction spectrum to the machine learning model.

8. An acoustic processing device comprising a processor and a memory storing a program which, when executed by the processor, causes the processor to function as:

a spatial normalization unit that generates a normalized spectrum by normalizing an orientation component of a microphone array for a target direction included in a spectrum of an acoustic signal acquired from each of a plurality of microphones forming the microphone array into an orientation component for a predetermined standard direction;

a mask function estimating unit that determines a mask function used for extracting a component of a target sound source arriving in the target direction on the basis of the normalized spectrum using a machine learning model;

a mask processing unit that estimates the component of the target sound source installed in the target direction by applying the mask function to the acoustic signal; and a model learning unit that determines a parameter set of the machine learning model such that a residual between an estimated value of the component of the target sound source acquired by applying the mask function to the acoustic signal representing sounds arriving from a plurality of sound sources including the target sound source and a target value of the component of the target sound source is small, wherein the model learning unit determines a space filter for generating a space correction spectrum from the normalized spectrum, and wherein the estimated value of the component of the target sound source is acquired by applying the mask function to the space correction spectrum.

* * * * *